US012018848B2

(12) United States Patent
Kersh et al.

(10) Patent No.: US 12,018,848 B2
(45) Date of Patent: Jun. 25, 2024

(54) HEAT EXCHANGER ASSEMBLY

(71) Applicant: Trane International Inc., Davidson, NC (US)

(72) Inventors: Bradley Kersh, Flint, TX (US); Daren Lee Epperson, Tyler, TX (US)

(73) Assignee: Trane International Inc., Davidson, NC (US)

( * ) Notice: Subject to any disclaimer, the term of this patent is extended or adjusted under 35 U.S.C. 154(b) by 61 days.

(21) Appl. No.: 17/525,540

(22) Filed: Nov. 12, 2021

(65) Prior Publication Data

US 2023/0151976 A1 May 18, 2023

(51) Int. Cl.
*F24F 1/0063* (2019.01)

(52) U.S. Cl.
CPC ..... *F24F 1/0063* (2019.02)

(58) Field of Classification Search
CPC ..... F24F 1/0067; F24F 1/0063; F24F 13/30; F28F 9/007; F28F 2009/224; F28F 2009/226; F28F 2275/08; F28F 17/005; F28D 1/0426; F28D 1/0477
See application file for complete search history.

(56) References Cited

U.S. PATENT DOCUMENTS 3,000,193 A 9/1961 Crider
3,831,670 A * 8/1974 Mullings ..... F28F 9/005 165/124
4,000,779 A 1/1977 Irwin
4,546,820 A 10/1985 Whipple
5,904,053 A * 5/1999 Polk et al. ..... F25D 21/14 62/285
5,979,171 A * 11/1999 Mitchell et al. ..... F24F 13/222 62/288
7,669,641 B2 * 3/2010 Rembold et al. ..... F25D 21/14 165/53
8,573,931 B2 11/2013 Blass et al.
11,029,060 B2 * 6/2021 Kawanori et al. ..... F24F 1/46
2010/0132917 A1 6/2010 Runk et al.
2018/0142907 A1 * 5/2018 Hong et al. ..... F24F 1/0067

* cited by examiner

*Primary Examiner* — Elizabeth J Martin
*Assistant Examiner* — Dario Antonio Deleon
(74) *Attorney, Agent, or Firm* — WOMBLE BOND DICKINSON (US) LLP

(57) ABSTRACT

Examples relate to heat exchangers that may include a baffle with apertures for use in an HVAC system. Some example heat exchangers may include a coil assembly that includes a pair of coil slabs each including first and second tube sheets and the baffle. A first end of the tube sheets may be located proximate a first end of the coil assembly. Each of the apertures of the baffle may be configured to detachably engage with a hook located on a first end of each tube sheet such that the plurality of apertures couple the baffle to the first end of the first tube sheet and the first end of the second tube sheet of each coil slab. The baffle thus may caps the coil assembly to minimize airflow through the first end of the coil assembly.

18 Claims, 11 Drawing Sheets

HEAT EXCHANGER ASSEMBLY

TECHNOLOGICAL FIELD

The present disclosure relates generally to an improved heat exchanger assembly, particularly an HVAC heat exchanger assembly.

BACKGROUND

Heating, ventilation, and/or air conditioning (HVAC) systems may generally be used in residential and/or commercial areas for heating and/or cooling to create comfortable temperatures inside those areas. As part of these systems, heat exchanger(s) may be used to transfer heat between air and a working fluid, and typically, these heat exchangers include a coil assembly.

These coil assemblies attempt to maximize heat transfer between the various fluids while at the same time optimizing costs, efficiencies, and other factors. As part of these systems, a baffle may be used to cap a portion of the coil assembly, protecting the coils from condensate and directing air flow. Generally, the baffle is attached via screws by puncturing a portion of the baffle. However, puncturing the coil assembly walls may reduce the overall performance of the heat exchanger, particularly over time.

As a result, there exists a need for an improved heat exchanger assembly, which enables easy alignment of the baffle with the coil assembly, while also capping the coil assembly. The improved heat exchanger assembly should also reduce a number of parts needed to couple the baffle with the coil assembly.

BRIEF SUMMARY

The present disclosure relates to a heat exchanger designed to overcome one or more of these existing issues. This assembly utilizes an improved baffle configured to utilize apertures that interact with tube sheets to address these deficiencies in the prior art.

The present disclosure thus includes, without limitation, the following example implementations.

Some example implementations provide an improved heat exchanger comprising a coil assembly comprising a pair of heat exchanger coil slabs, each slab comprising a first tube sheet and a second tube sheet, the first and second tube sheets each including a first end located proximate a first end of the coil assembly, the first end of each tube sheet having a hook; and a baffle comprising: a plurality of apertures located on the baffle, wherein each aperture of the plurality of apertures is detachably engaged with the hook located on the first end of the first and second tube sheets such that the plurality of apertures couple the baffle to the first end of the first tube sheet and the first end of the second tube sheet of each coil slab, wherein the baffle caps the coil assembly to minimize airflow through the first end of the coil assembly.

In some example implementations of the heat exchanger of any example implementation, or any combination of any preceding example implementations, the baffle includes a v-shaped panel, wherein the v-shaped panel is shaped at a first angle.

In some example implementations of the heat exchanger of any example implementation, or any combination of any preceding example implementations, the first end of the coil assembly comprises a v-shaped end, wherein the v-shaped end is shaped at a second angle that is different from the first angle when the baffle is uncoupled from the coil assembly.

In some example implementations of the heat exchanger of any example implementation, or any combination of any preceding example implementations, a difference between the first angle and the second angle is at least five degrees.

In some example implementations of the heat exchanger of any example implementation, or any combination of any preceding example implementations, a force created when the v-shaped panel deforms to allow the first angle on the v-shaped panel to more closely align with the second angle on the v-shaped end helps secure the baffle to the coil assembly.

In some example implementations of the heat exchanger of any example implementation, or any combination of any preceding example implementations, the baffle includes two side flanges extending from the v-shaped panel on opposite sides, wherein the apertures are located on at least one of the side flanges.

In some example implementations of the heat exchanger of any example implementation, or any combination of any preceding example implementations, each of the side flanges includes two apertures of the plurality of apertures, such that when the v-shaped panel of the baffle is arranged over the coil assembly, each of the hooks engages a corresponding aperture.

In some example implementations of the heat exchanger of any example implementation, or any combination of any preceding example implementations, the baffle further comprises an outer flange extending outward from each of the side flanges for flexing the v-shaped panel during assembly.

In some example implementations of the heat exchanger of any example implementation, or any combination of any preceding example implementations, the hook comprises an inner engagement edge and an outer curved edge, wherein the inner engagement edge engages a respective one of the plurality of apertures, and the outer curved edge is configured to engage the outer flange for deflecting the respective side flange.

Some example implementations provide an HVAC system comprising a housing; and a blower arranged within the housing, wherein the heat exchanger of any example implementation, or any combination of any preceding implementations, arranged within the housing to receive pressurized air from the blower.

In some example implementations of the HVAC system of any example implementation, or any combination of any preceding example implementations, the heat exchanger further including a fastener cap coupled to at least one aperture and configured to seal the aperture.

In some example implementations of the HVAC system of any example implementation, or any combination of any preceding example implementations, the first end of the coil assembly of the heat exchanger comprises a v-shaped end, wherein the v-shaped end is shaped at a second angle that is different from the first angle when the baffle is uncoupled from the coil assembly.

In some example implementations of the HVAC system of any example implementation, or any combination of any preceding example implementations, a force created when the v-shaped panel deforms to allow the first angle on the v-shaped panel to more closely align with the second angle on the v-shaped end helps secure the baffle to the coil assembly.

In some example implementations of the HVAC system of any example implementation, or any combination of any preceding example implementations, the HVAC system further comprises an auxiliary heat exchanger arranged within the housing.

Some example implementations provide a method for assembling a heat exchanger baffle with a coil assembly comprising a pair of heat exchanger coil slabs each including a first tube sheet and a second tube sheet, the method comprising: orienting the baffle comprising a plurality of apertures located on the baffle relative to a first end of the first tube sheet and the first end of the second tube sheet, the first ends of the first and second tube sheets being located proximate a first end of the coil assembly; and detachably engaging each aperture of the plurality of apertures with a hook located on the first end of one of the first tube sheet or the second tube sheet so as to couple the baffle to the first end of the first tube sheet and the first end of the second tube sheet and thereby cap the coil assembly to minimize airflow through the first end of the coil assembly.

In some example implementations of the method of any example implementation, or any combination of any preceding example implementations, the baffle includes a v-shaped panel defining a first angle and the first end of the coil assembly comprises a v-shaped end defining a second angle that is different from the first angle when the baffle is uncoupled from the coil assembly, and wherein orienting the baffle comprises orienting the baffle so the v-shaped panel is positioned within the v-shaped end of the coil assembly.

In some example implementations of method of any example implementation, or any combination of any preceding example implementations, detachably engaging each of the plurality of apertures comprises deforming the v-shaped panel to allow the first angle on the v-shaped panel to align more closely with the second angle on the v-shaped end when each aperture of the plurality of apertures is detachably engaged with the corresponding hook.

In some example implementations of the method of any example implementation, or any combination of any preceding example implementations, the baffle includes two side flanges extending from the v-shaped panel on opposite sides, and the apertures are located on at least one of the side flanges, and wherein orienting the baffle comprises orienting the side flanges so the apertures located on the at least one side flange is arranged proximate to the corresponding hook.

In some example implementations of the method of any example implementation, or any combination of any preceding example implementations, there are four hooks located on the first end of each of the first and second tube sheets and the plurality of apertures comprises four apertures, each of the side flanges including two of the four apertures, and wherein orienting the baffle comprises orienting the side flanges so that each of the four apertures is arranged proximate to the corresponding hook.

In some example implementations of the method of any example implementation, or any combination of any preceding example implementations, the hook comprises an inner engagement edge and an outer curved edge, and wherein detachably engaging each aperture comprises engaging the outer curved edge to an outer flange extending outward from each of the side flanges of the baffle to guide the at least one aperture to detachably engage with the inner engagement edge.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
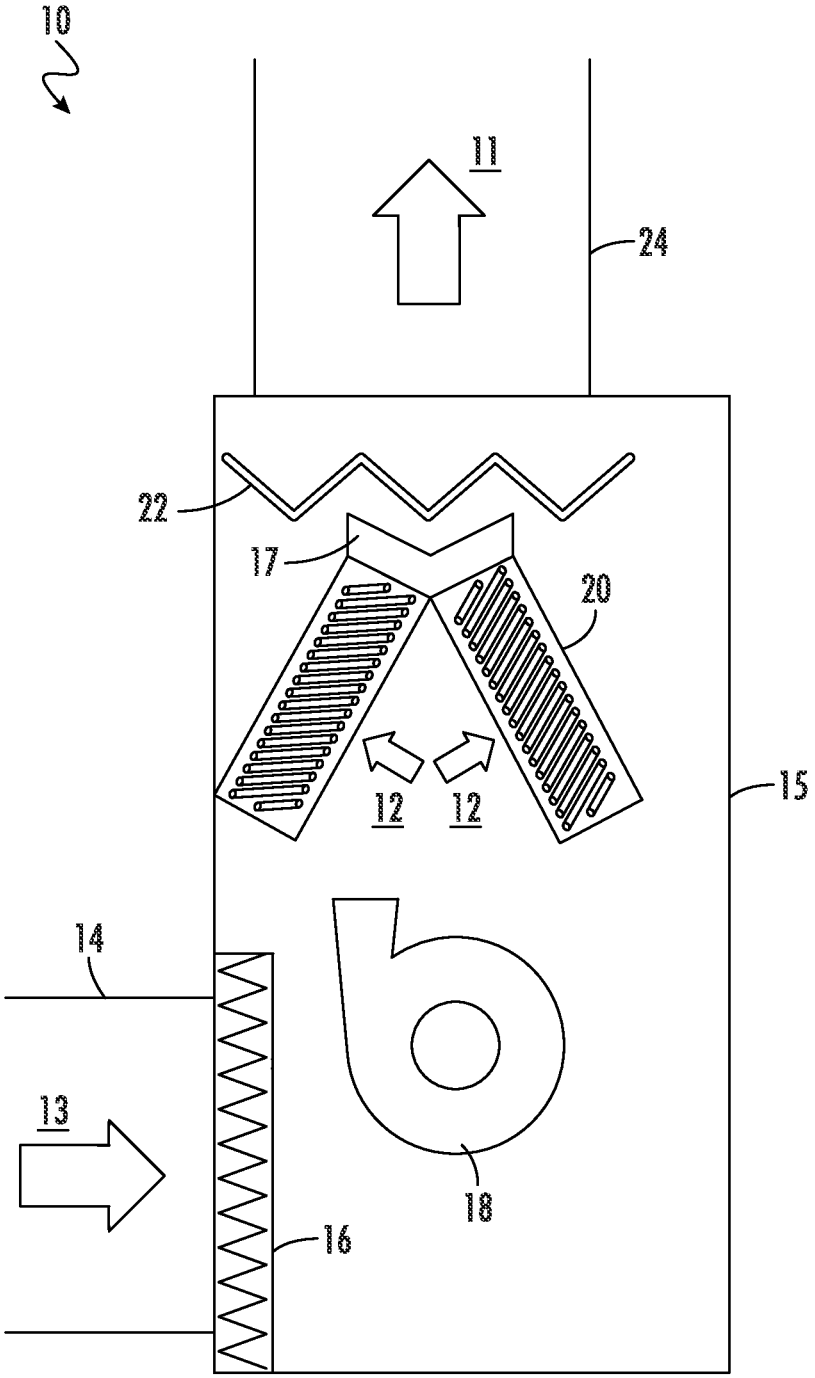
FIG. 1 is a schematic of an air handling unit including a heat exchanger according to an example embodiment of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure. It is understood that such terms are not used in any absolute sense.

Example implementations of the present disclosure relate generally to an improved heat exchanger for use in an HVAC device. Example implementations will be primarily described in conjunction with air handling units used in HVAC applications, but it should be understood that example implementations may be utilized in conjunction with a variety of other applications. For example, other HVAC devices include but are not limited to cased coils, uncased coils, indoor units, outdoor units, packaged units, furnaces, heaters (electric or otherwise) as well as other devices generally including water heaters, kitchen appliances, and the like may utilize the assembly described herein.

FIG. 1 shows a schematic of the components that may comprise an example air handling unit or a HVAC system 10. In this example, these components are located within a housing 15 of the air handling unit 10 and the conditioned air path is indicated by arrow 11. The air path flows through the air handling unit 10, passing through the various components. As indicated by arrows 12 the air is directed through the heat exchanger 20, often in a manner that ensures sufficient heat transfer between the coils within the heat exchanger and the air. Return air 13 from a conditioned space and/or outdoor air are directed to the air handling unit via return air duct 14. In this example, the air first passes through a mechanical filter 16, before entering an inlet of a blower or fan 18 arranged within the housing 15. The blower 18 pressurizes the air and directs it to a heat exchanger 20 arranged within the housing 15 to receive the pressurized air from the blower 18. The heat exchanger 20 includes a baffle 17 as contemplated by the present disclosure that is capable of capping coils of the heat exchanger 20 to minimize airflow through a first end of a coil assembly of the heat exchanger 20. For example, the baffle 17 may include additional features such as an aperture, which will be described in more detail below. The depicted embodiment also includes a heating element 22 located downstream from the heat exchanger. The conditioned air is then directed into the supply air duct 24, which directs the air into a conditioned space (not shown).

In other implementations, the air handling unit 10 may be located horizontally with heat exchanger 20 and/or the heating element 22 disposed on one side of the blower 18. The heating element 22 may be an electric heating element, and in some embodiments, potentially embodiments where the HVAC system is a heat pump, 22 could be an auxiliary heat exchanger arranged within the housing 15. In other examples, the blower is located down stream of either the heat exchanger or the heating element. In still other examples, the heat exchanger and/or the heating element may be disposed within a fluid duct of the air handling unit and may also be selectively removable from the air handling unit. It is appreciated that more or less of these components may be utilized, and that they may be arranged in different configurations provided they provide the functionality described herein. In some embodiments, the heat exchanger may be used in combination with a furnace (not shown). In these examples, the furnace may include some or all of the elements shown in FIG. 1.

Figure 2:
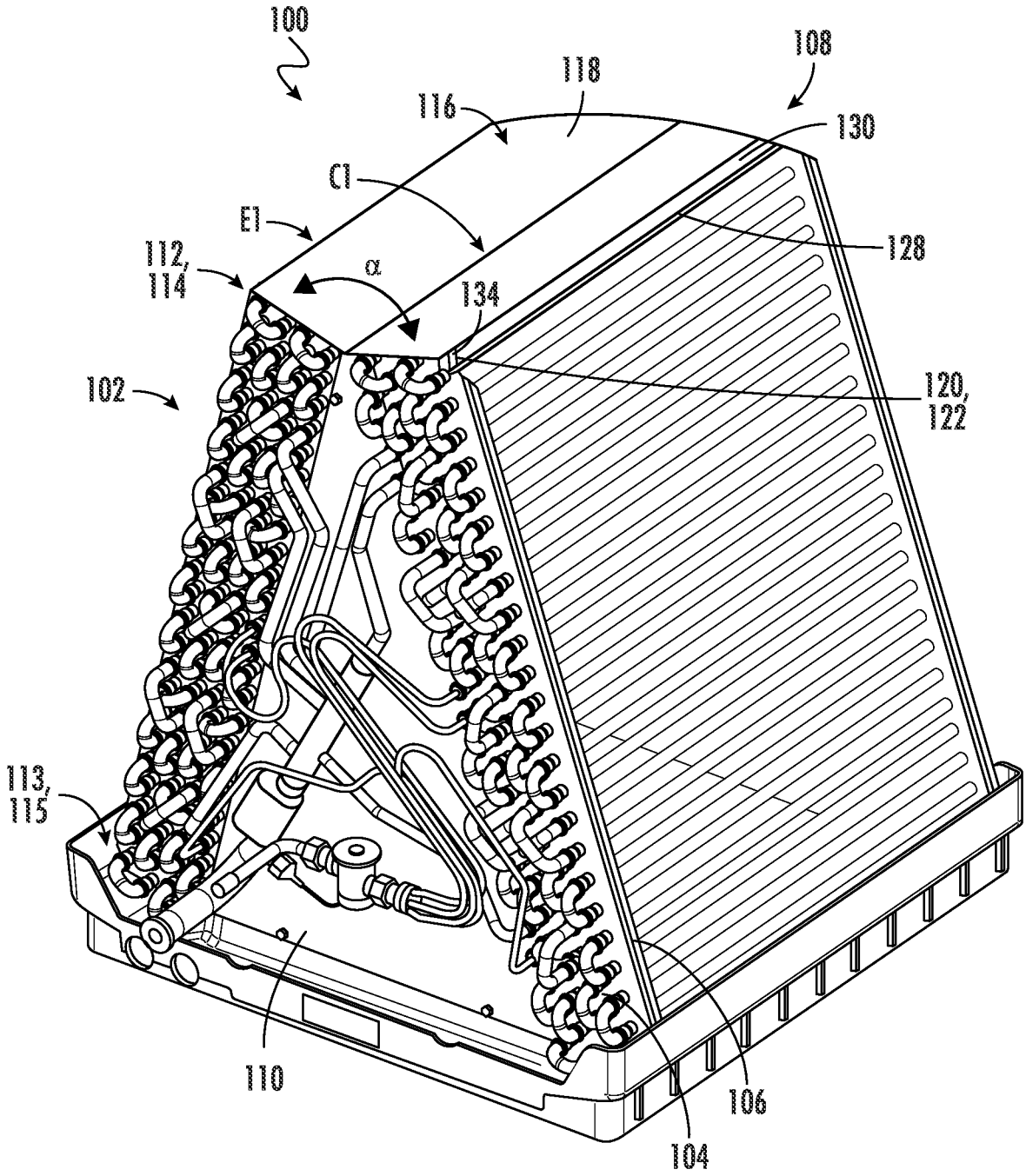
FIG. 2 is a schematic of a heat exchanger according to an example embodiment of the present disclosure.
Figure 3:
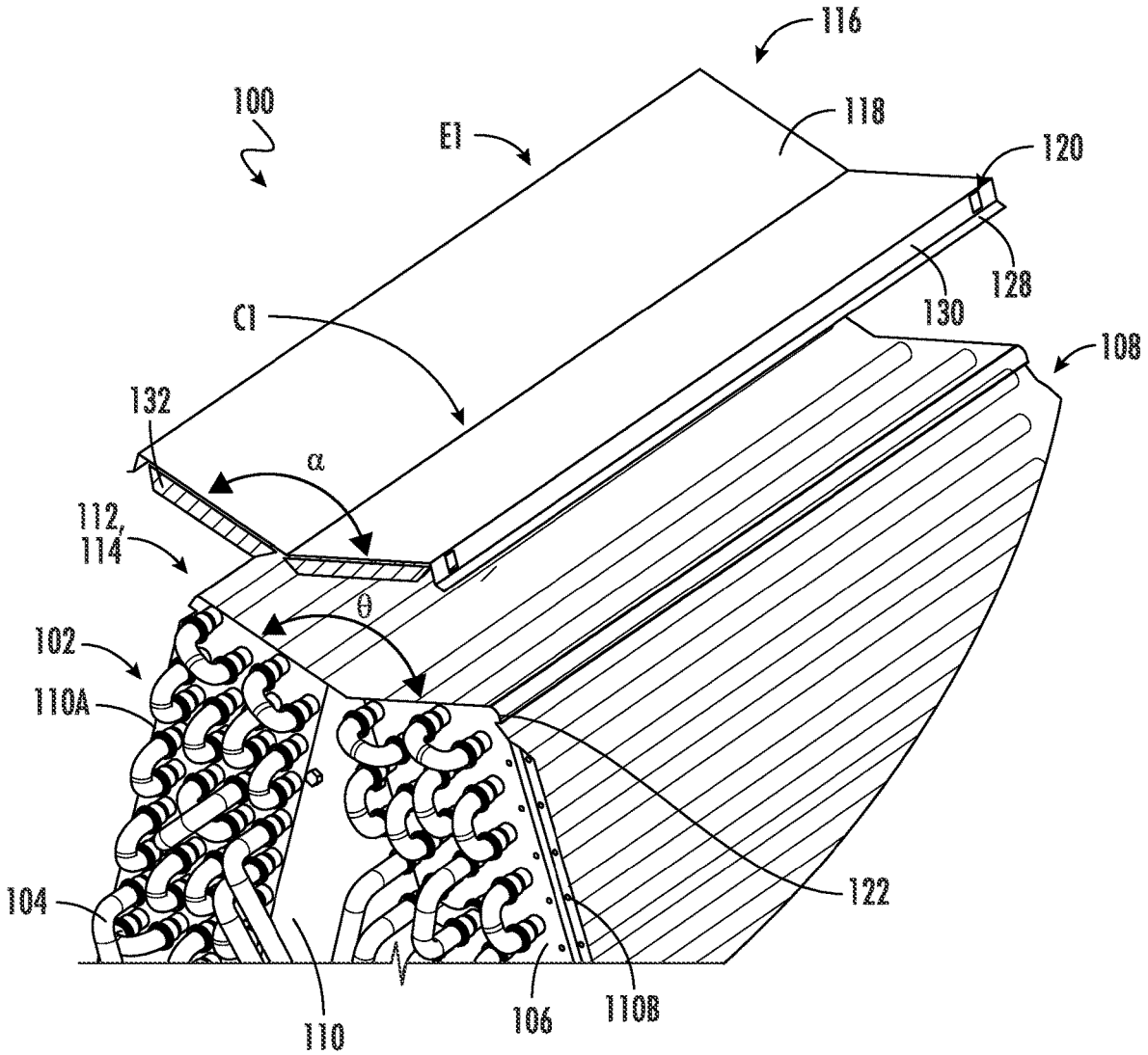
FIG. 3 is a close-up schematic of a heat exchanger including a baffle uncoupled from a coil assembly thereof, according to an example embodiment of the present disclosure.

FIGS. 2 and 3 show example embodiments of a heat exchanger assembly 100, which may be utilized in an air handler unit located within a structure, such as a residence. FIG. 2 shows a heat exchanger 100. FIG. 3 shows an exploded close up of a first end of the heat exchanger 100. The heat exchanger 100 comprises a coil assembly 102 comprising a pair of heat exchanger coil slabs 104, each slab 104 comprising a first tube sheet 106 and a second tube sheet 108. In some example embodiments, and as depicted in FIGS. 2 and 3, the first tube sheets 106 are connected to each other and the second tube sheets 108 are connected to each other. As shown, an end baffle 110 is arranged between the first tube sheets 106 and another end baffle 110 is arranged between the second tube sheets 108. The end baffles 110 and the respective tube sheets 106, 108 may be integrally connected to one another or may be joined together via one or more fastener, welding, adhering, or the like.

The slabs 104 may be arranged relative to one another so that the heat exchanger 100 forms an "A" shape (or an inverted "V" shape) when viewed from the front. Each of the slabs 104 may be arranged such that coils extend between the first and second tube sheets 106, 108. Although the slabs 104 of the coil assembly 102 are illustrated in an A-frame configuration in FIGS. 2 and 3, the coil assembly 102 may be slightly different than what is shown therein. For example, the coil assembly 102 may comprise additional or fewer groupings of coils and/or tube sheets arranged in other configurations, as well as fewer or any additional or different components not shown in FIGS. 2 and 3. Accordingly, some of the components shown in FIGS. 2 and 3 will not be described in detail and are known to those of skill in the art.

In some example implementations, and as illustrated in FIG. 2, the first and second tube sheets 106, 108 may each include a first end or edge 112 located proximate a first end or edge 114 of the coil assembly 102 and an opposing second end or edge 113 of each of the first and second tube sheets 106, 108 located proximate a second end 115 of the coil assembly 102. Side edges of each of the first and second tube sheets 106, 108 may be arranged between the opposing first and second ends. The first and second tube sheets 106, 108 may thus be oriented so that when an air handling unit (such as that shown in FIG. 1) is in a vertical orientation, the first ends 112 of each of the tube sheets 106, 108 are arranged more proximate toward an apex or top of the converging A-configuration, while the opposing seconds ends 113 are arranged more proximate to the ground.

Based on an arrangement of the first and second tube sheets 106, 108 (such as, e.g., in the converging A-configuration), an interior angle θ is formed between the first ends 112 of adjacent tube sheets, i.e., such as between the first ends 112 of the first tube sheets 106 and between the first ends 112 of the second tube sheets 108. Thus, and as a result of the angle θ formed between the first ends 112 of adjacent tube sheets, the first end 114 of the coil assembly 102 comprises a v-shaped end, though the end may be of another shape.

Figure 4:
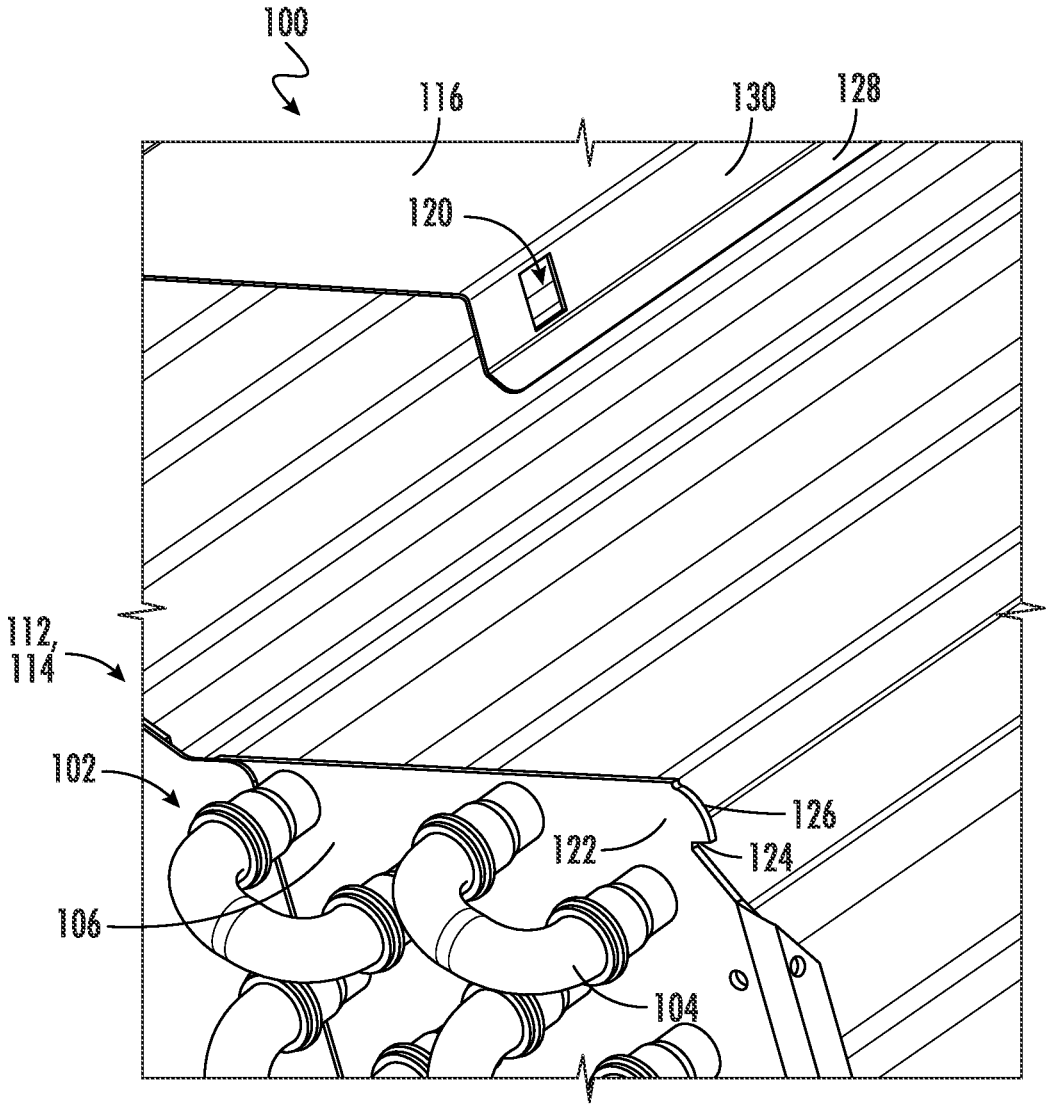
FIG. 4 is a detailed view of FIG. 2 with the baffle uncoupled from the coil assembly, according to an example embodiment of the present disclosure.

Each of the first ends 112 of each tube sheet 106, 108 may also have at least one tab or hook 122 located on the first end 112 thereof. In some example embodiments, the first and second tube sheets 106, 108 each comprise one hook 122 located proximate the first end 112 (four hooks total), although two, three, four hooks may be arranged proximate the first end 112 of all of the tube sheets or just one, two, or three of the tube sheets. The hook 122 may be arranged at an outer corner of the first end 112, as shown in FIG. 3, for example, though it may also be inset therefrom. In some further example embodiments, and as shown in FIG. 4, the hook 122 comprises an inner engagement edge 124 and an outer curved edge 126.

The heat exchanger 100 may further comprise a baffle 116 comprising a panel 118 and two side flanges 130 extending from the panel 118 on opposite sides. The side flanges 130 may approximate a right angle with respect to the adjacent portion of the panel 118. Additionally, each side flange 130 may include an outer flange 128 extending outward from each of the side flanges 130 for flexing the v-shaped panel 118 during assembly. The outer flange 128 may be bent 45 degrees relative to the adjacent side flange 130. The baffle 116 may be shaped to complementarily couple to (e.g., combine or connect) or be received by the coil assembly 102. In the depicted embodiment, where the coil assembly 102 is in the A-configuration, with the angle θ at the apex thereof, the panel 118 of the baffle 116 may be or include a v-shaped panel, where the v-shaped panel is shaped at an angle α (referred to herein as the first angle). In other embodiments, the baffle 116 may comprise a panel 118 of a different shape or with a different curvature, such as, for example, a flat panel, a rounded panel, etc.

In some embodiments, the first angle α may correspond to the angle θ (hereinafter referred to the second angle) when the baffle 116 is coupled to the coil assembly 102. For example, where the second angle θ is 160 degrees, the first angle α may correspondingly be about 160 degrees when the baffle 116 is coupled to the coil assembly 102. In some embodiments, the v-shaped end may be shaped at the second angle θ, which may be different from the first angle α when the baffle 116 is uncoupled from the coil assembly 102. For example, the first angle α may be smaller than the second angle θ when the baffle 116 is uncoupled from the coil assembly 102. In one example, a difference between the first angle α and the second angle θ is at least five degrees. In this example, the first angle α may be an angle ranging from five to ten degrees less than the second angle θ. More particularly, the panel 118 may be formed of a material (e.g., carbon steel, alloy steel, stainless steel, aluminum, a nonferrous material, etc.) that enables the baffle 116 to deflect from its original shape (for example expanding the first angle α) to couple to the coil assembly 102. The baffle 116 may then return to its original shape (and the first angle α) upon uncoupling of the baffle 116 from the coil assembly 102.

In some embodiments, the deformation of the baffle 116 is used to create a force between the baffle 116 and the coil assembly 102. The force created when the v-shaped panel 118 deforms to allow the first angle α to more closely align with the second angle θ on the v-shaped end helps secure the baffle 116 to the coil assembly 102. In some embodiments, this force is also used to secure other components (e.g., a gasket 132, FIG. 3) between the baffle 116 and the coil assembly 102, potentially providing a seal to direct air flow appropriately through the heat exchanger. For example, the first angle α may be smaller than second angle θ when the baffle 116 is uncoupled from the coil assembly 102. When the baffle 116 is elastically deformed and aligns with the coil assembly 102 such that the first angle α corresponds more closely with the second angle θ, the deformation may create a spring force across the baffle, for example bowing each segment of the v-shaped panel 118. In these examples, the spring force developed in the baffle 116 results in a normal force exerted downwards by the hook 122 of the tube sheets 106, 108 onto the baffle 116, which directs an edge E1 of the baffle 116 downwards towards the coil assembly 102. A pressing contact point is created at a center C1 of the baffle 116.

In some embodiments, the material associated with the baffle 116 and the angles α, θ are selected to encourage retention between the baffle 116 and the coil assembly 102. For example, the attributes of the baffle may be designed based on the power associated with the circulation fan (e.g., fan 18 in FIG. 1) used in the system. This fan may circulate an air flow through the heat exchanger at a given static pressure, e.g., 1 in water column, and the spring force of the baffle may be designed to force the center of the baffle 116 to abut the coil assembly 102 at a force greater than the air pressure at that point in the system.

In some example embodiments, the baffle 116 may also comprise a plurality of apertures 120 located on the baffle 116. Each aperture 120 of the plurality of apertures is configured to detachably engage with a hook 122 located on the first end 112 of the first and second tube sheets 106, 108. As illustrated in FIG. 4, for example, the apertures 120 are located on at least one of the side flanges 130. As shown in FIGS. 6-11, one example embodiment of the present disclosure, each of the side flanges 130 includes two apertures 120 (four apertures total) of the plurality of apertures, such that when the v-shaped panel 118 is arranged over the coil assembly 102, each of the hooks 122 engages a corresponding aperture 120. However, there may be fewer or more apertures in different locations on the baffle 116, such as on the panel 118.

Figure 5:
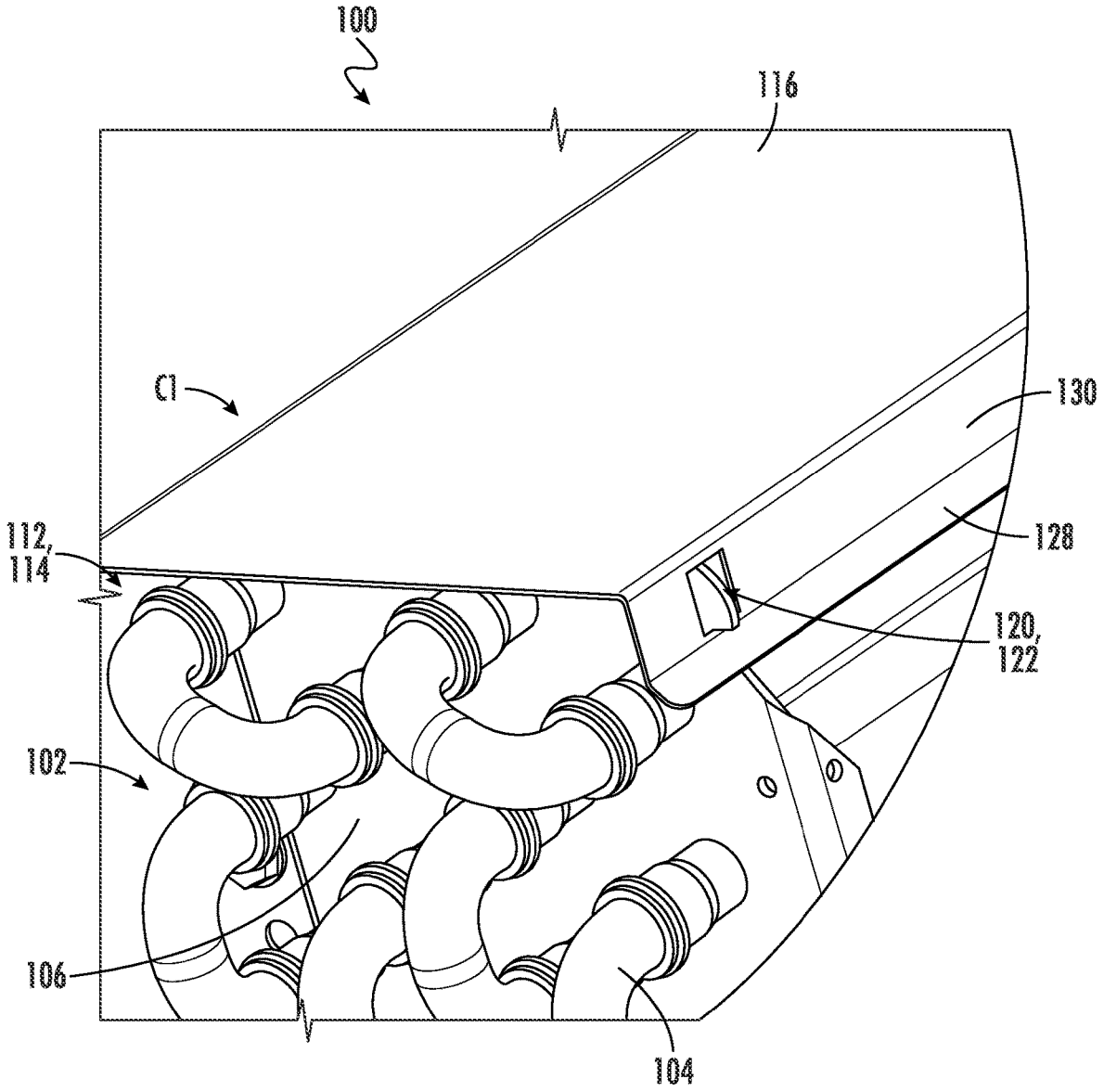
FIG. 5 is a detailed view of FIG. 2 with the baffle coupled to the coil assembly, according to an example embodiment of the present disclosure.
Figure 6:
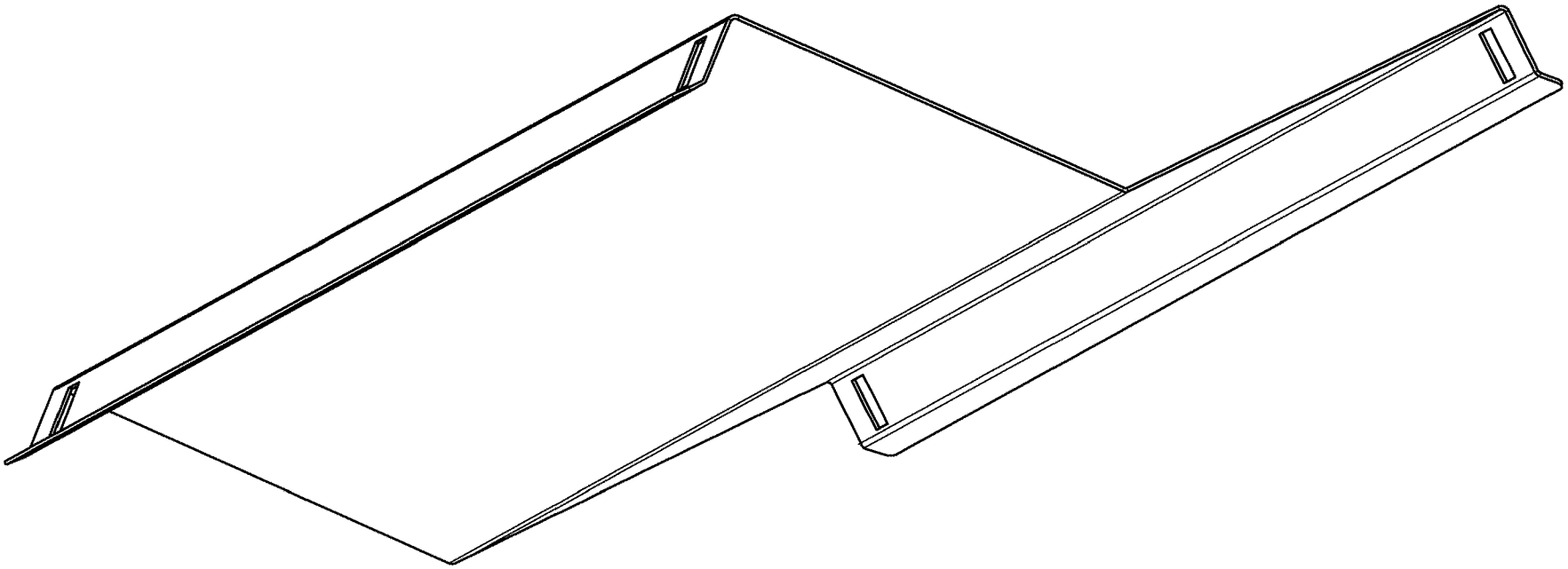
FIG. 6 is an is an angled view of a baffle, according to an example embodiment of the present disclosure.
Figure 7:
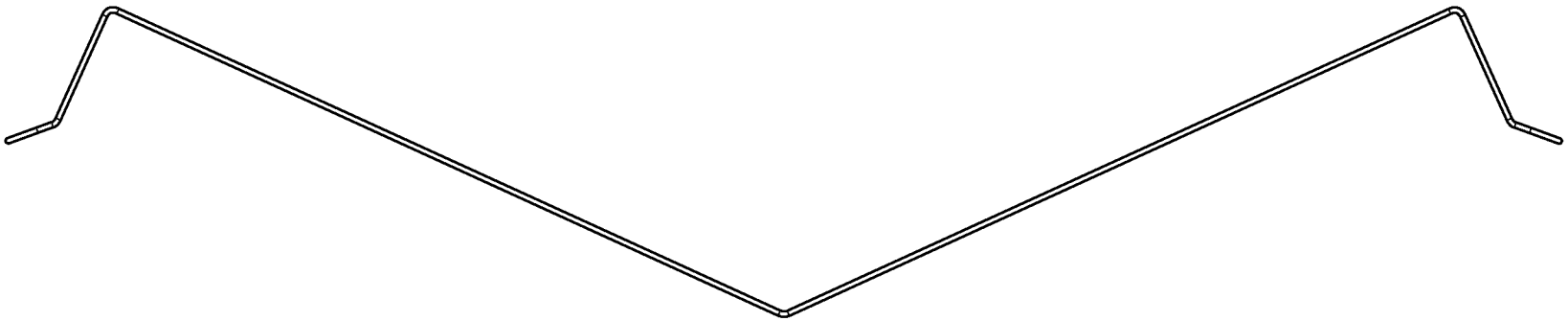
FIG. 7 is a front view of a baffle, which when rotated 180 degrees to a rear view is the same, according to an example embodiment of the present disclosure.
Figure 8:
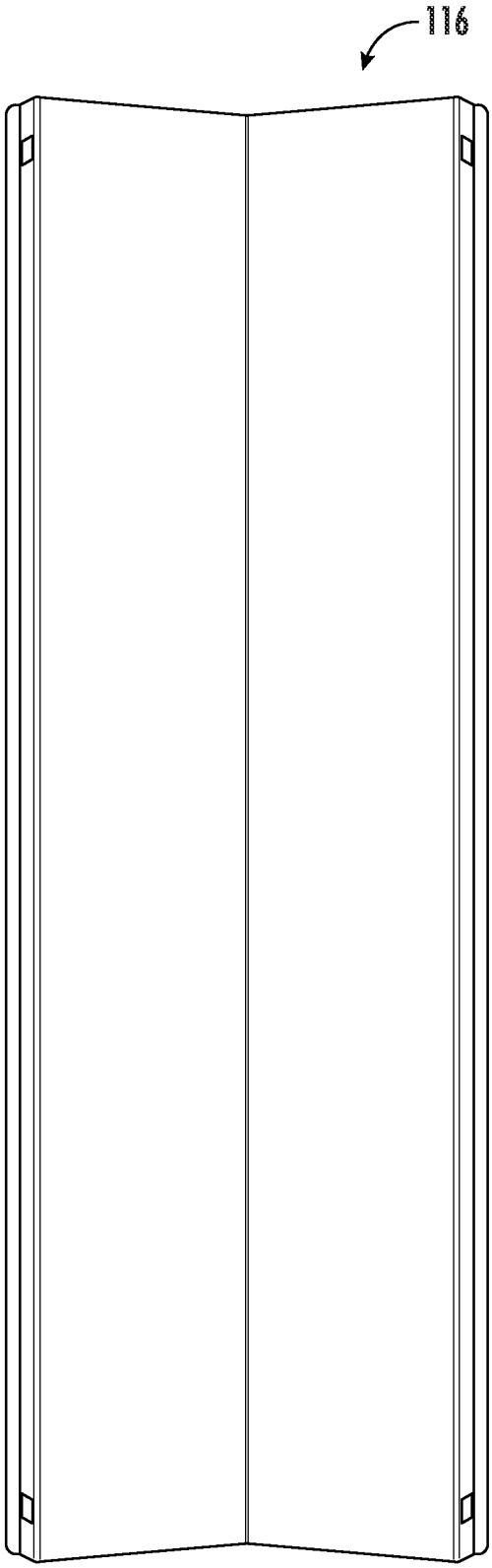
FIG. 8 is a top view of a baffle, according to an example embodiment of the present disclosure.
Figure 9:
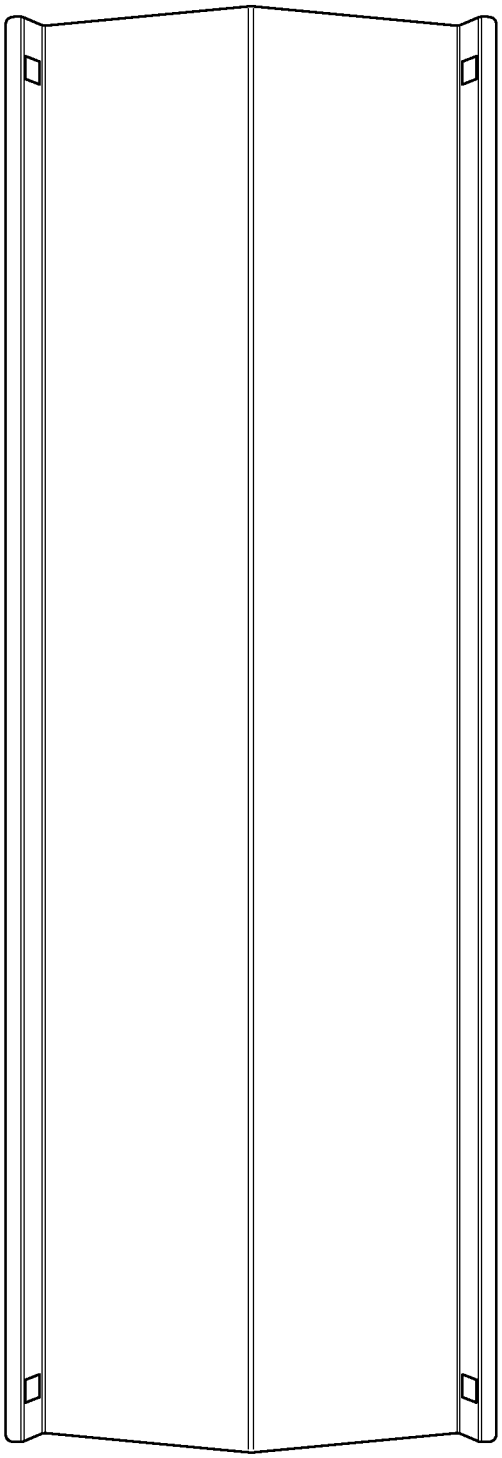
FIG. 9 is a bottom view of a baffle, according to an example embodiment of the present disclosure.
Figure 10:
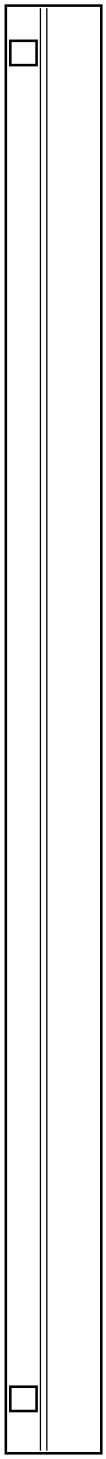
FIG. 10 is a left side view of a baffle, according to an example embodiment of the present disclosure.
Figure 11:
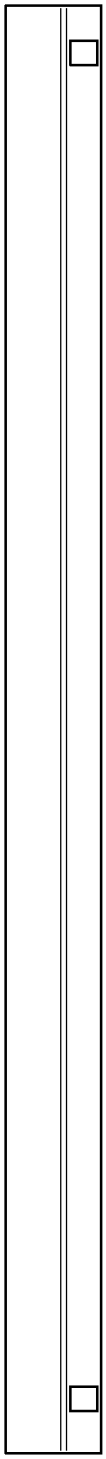
FIG. 11 is a right side view of a baffle, according to an example embodiment of the present disclosure.

One example embodiment of the detachable engagement of the apertures 120 with the tube sheets 106, 108, is shown in more detail in FIGS. 4 and 5. More particularly, FIG. 4 illustrates the orientation/alignment of one of the apertures 120 relative to the first end 112 of the first tube sheet 106. FIG. 5 illustrates the engagement of this aperture 120 with the hook 122 to thereby couple the baffle 116 to the first ends 112 of the first tube sheet 106 (and the second tube sheet 108) of each coil slab 104. In particular, when the panel 118 of the baffle 116 is arranged over the coil assembly 102, each of the hooks 122 engages a corresponding aperture 120 via the various edges of the hooks 122. For example, the inner engagement edge 124 of the hook 122 engages a respective one of the plurality of apertures 120 located on the baffle 116, and the outer curved edge 126 of the hook 122 is configured to engage the outer flange 128 of the baffle 116 for deflecting the respective side flange 130.

In some embodiments, the outer flange(s) 128 are designed to engage with the outer curved edge 126 of the hook 122. For example, the outer flange 128 may be angled away from the side flange 130, and the curved edge 126 may include a curve that mirrors the angle of the outer flange, at least in some portions. In these examples, the shape of the outer flange 128 and the outer curved edge 126 may assist in assembly of the baffle 116 with the coil assembly 102. For example, the outer flange 128 may engage with the curved edge 126, directing the connectors on the side flange 130 onto the inner engagement edge 124 of the hook 122. Thus, the baffle 116 may be arranged to cap the coil assembly 102 when the plurality of apertures 120 are engaged (i.e., cooperates) with respective hooks 122.

Because the hook 122 and the aperture 120 are detachably engaged, this allows the baffle 116 to be easily separated and removed from the first ends 112 of the tube sheets 106, 108 so as to allow for access to the heat exchanger 100 during maintenance, and then recoupled once the maintenance is done. The baffle 116 may thus be configured to be secured to the coil assembly 102 when the plurality of apertures 120 is engaged with a corresponding hook 122. In particular, for example, the first angle $\alpha$ is smaller than the second angle $\theta$ when the baffle 116 is in its original shape. User manipulation of the baffle 116 to align the baffle 116 with the coil assembly 102 results in displacement of the edges E1 of the baffle so that the apertures 120 align with and engage the hooks 122. Conversely, to uncouple the baffle 116 from the coil assembly 102, a user may grasp one or both of the outer flanges 128 and pull outwardly to move the outer curved edge 126 of each aperture 120 into/out of engagement with its respective hook 122. In this manner, the baffle 116 is arranged to cap the coil assembly 102 when the plurality of apertures 120 are engaged.

A size and/or shape of the apertures 120 and the respective hooks 122 may be designed so as to simultaneously enable ease of assembly and secure retention of the baffle 116 to the coil assembly 102. For example, an inner engagement edge 124 of the hook 122 may be between about 0.12 inches and about 0.16 inches in length, while the outer curved edge 126 of the hook 122 may be between about 0.365 inches and about 0.385 inches in length. Additionally, a width of the apertures 120 (front-to-back) may be between about 0.26 inches and about 0.32 inches in length. As such, with hooks 122 and apertures 120 sized and shaped as contemplated herein, secure engagement of the hooks 122 with the apertures 120 may be enabled, despite manufacturing process variations.

In some other example embodiments (not shown), an 'integrated' connector may be utilized rather than the aperture 120 and hook 122 or in addition to the aperture 120 and hook 122. As used herein, an integrated connector is one that is so formed with the baffle 116 such that they are of one unit. Thus, the integrated connectors may be formed so that they do not require any additional hardware (e.g., screw fasteners) in order to detachably engage the tube sheets 106, 108. However, and as otherwise contemplated, the integrated connectors may be separate from, but fixedly coupled to, the baffle 116 such that they are considered integrated therewith. Regardless, the integrated connector(s) may configured to cap the coil assembly 102 when the plurality of apertures are engaged (i.e., interconnected or joined) with the first ends 112 of the tube sheets 106, 108.

In some example embodiments, and as shown for example in FIG. 3, a gasket 132 may be secured between the baffle 116 and the first end 112 of at least one of the first and second tube sheets 106, 108 when the apertures are engaged. In some embodiments, the gasket 132 is made from an elastic material, such as, for example, a deformable elastic (e.g., thermoplastic vulcanizate) material rated for temperatures at least as great as 135° C. The gasket 132 may substantially surround a perimeter formed at an intersection between the baffle 116 and at least one of the first and second tube sheets 106, 108, or may only surround a portion of the perimeter therebetween. Regardless, the gasket 132 may be removable or remain coupled to one of the baffle 116 or the tube sheets 106, 108 when the baffle 116 is uncoupled from the coil assembly 102. Notably, in some example embodiments, a height of each aperture 120 is designed to provide a small gap between the first end of the tube sheets and a bottom of the baffle 116 to allow for easier disassembly of the baffle 116 from the coil assembly 102, and to provide a small tolerance to allow for installation of the gaskets 132.

In some example embodiments, and as shown in FIG. 2, a fastener cap 134 may be coupled to at least one aperture 120 and be configured to seal the aperture 120. The fastener cap 134 may be a waterproof or water resistant material that is able to partially or substantially cover the aperture 120 to prevent debris, water, and the like from entering the coil assembly 102 through the aperture 120. In some other example embodiments, crimped on shielding may be utilized to cover the apertures 120 to prevent condensation from leaving the apertures 120 and/or a drain pan in the air handling unit 10.

Turning now to FIGS. 6-11, these figures show various views of the embodiment of a heat exchanger baffle, such as the baffle 116 illustrated in FIGS. 2-5. The embodiment of the baffle depicted in FIGS. 6-11 may include many of the features discussed above and may be configured in a similar manner.

Figure 12:
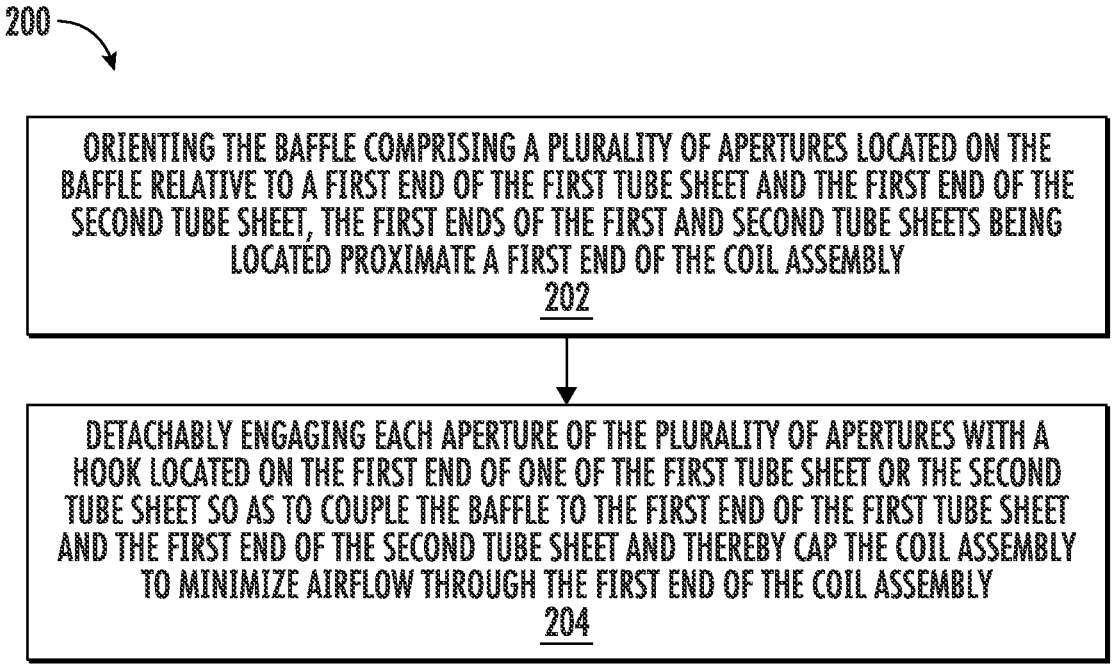
FIG. 12 is a method flow diagram showing a method for assembling a heat exchanger baffle with a coil assembly, according to an example embodiment of the present disclosure.

FIG. 12 illustrates a method flow diagram for a method for assembling a heat exchanger baffle with a coil assembly comprising a pair of heat exchanger coil slabs each including a first tube sheet and a second tube sheet. The method, generally designated 200, includes orienting the baffle comprising a plurality of apertures located on the baffle relative to a first end of the first tube sheet and the first end of the second tube sheet, the first ends of the first and second tube sheets being located proximate a first end of the coil assembly, block 202. The method 200 also comprises detachably engaging each aperture of the plurality of apertures with a hook located on the first end of one of the first tube sheet or the second tube sheet so as to couple the baffle to the first end of the first tube sheet and the first end of the second tube sheet and thereby cap the coil assembly to minimize airflow through the first end of the coil assembly, block 204.

The method 200 further comprises, in some example embodiments, that the baffle includes a v-shaped panel defining a first angle and the first end of the coil assembly comprises a v-shaped end defining a second angle that is different from the first angle when the baffle is uncoupled from the coil assembly, and wherein orienting the baffle comprises orienting the baffle so the v-shaped panel is positioned within the v-shaped end of the coil assembly. In some example embodiments, detachably engaging each of the plurality of apertures comprises deforming the v-shaped panel to allow the first angle on the v-shaped panel to align more closely with the second angle on the v-shaped end when each aperture of the plurality of apertures is detachably engaged with the corresponding hook. In some still further example embodiments, the baffle includes two side flanges extending from the v-shaped panel on opposite sides, and the apertures are located on at least one of the side flanges, and wherein orienting the baffle comprises orienting the side flanges so the apertures located on the at least one side flange is arranged proximate to the corresponding hook. In still further example embodiments, there are four hooks located on the first end of each of the first and second tube sheets and the plurality of apertures comprises four apertures, each of the side flanges including two of the four apertures, and wherein orienting the baffle comprises orienting the side flanges so that each of the four apertures is arranged proximate to the corresponding hook. In even further example embodiments, the hook comprises an inner engagement edge and an outer curved edge, and wherein detachably engaging each aperture comprises engaging the outer curved edge to an outer flange extending outward from each of the side flanges of the baffle to guide the at least one aperture to detachably engage with the inner engagement edge.

Accordingly, the heat exchanger assemblies discussed herein can be used in multiple different devices and for various purposes. In some embodiments, as discussed herein, the heat exchanger is a refrigerant coil heat exchanger. Otherwise, the heat exchanger discussed herein may be used with a furnace, and in these embodiments, the heat exchanger may allow for an improved process for manufacturing and conducting maintenance on HVAC units, by reducing the number of parts needed to secure the baffle to the coil assembly and thus streamlining the process for installing the air handling unit.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heat exchanger comprising:

a coil assembly comprising a pair of heat exchanger coil slabs, each slab comprising a first tube sheet and a second tube sheet, the first and second tube sheets each including a first end located proximate a first end of the coil assembly, the first end of each tube sheet having a hook; and a baffle comprising:

a panel and two side flanges extending from the panel on opposite sides in a direction towards the first and second tube sheets, a plurality of apertures located on the baffle, wherein the apertures are located on at least one of the side flanges, wherein each aperture of the plurality of apertures is detachably engaged with the hook located on an outer corner of the first end of each tube sheet such that the plurality of apertures couple the baffle to the first end of the first tube sheet and the first end of the second tube sheet of each coil slab, wherein the baffle caps the coil assembly to minimize airflow through the first end of the coil assembly.

2. The heat exchanger of claim 1, wherein the panel is a v-shaped panel, wherein the v-shaped panel is shaped at a first angle.

3. The heat exchanger of claim 2, wherein the first end of the coil assembly comprises a v-shaped end, wherein the v-shaped end is shaped at a second angle that is different from the first angle when the baffle is uncoupled from the coil assembly.

4. The heat exchanger of claim 3, wherein a difference between the first angle and the second angle is at least five degrees.

5. The heat exchanger of claim 3, wherein the baffle comprises a deformable material, the deformable material configured to create a force when the v-shaped panel deforms to allow the first angle on the v-shaped panel to more closely align with the second angle on the v-shaped end to help secure the baffle to the coil assembly.

6. The heat exchanger of claim 2, wherein each of the side flanges includes two apertures of the plurality of apertures, such that when the v-shaped panel of the baffle is arranged over the coil assembly, each of the hooks engages a corresponding aperture.

7. The heat exchanger of claim 2, wherein the baffle further comprises an outer flange extending outward from each of the side flanges for flexing the v-shaped panel during assembly.

8. The heat exchanger of claim 1, wherein the hook comprises an inner engagement edge and an outer curved edge, wherein the inner engagement edge engages a respective one of the plurality of apertures, and the outer curved edge is configured to engage the outer flange for deflecting the respective side flange.

9. An HVAC system comprising:

a housing; and a blower arranged within the housing, wherein the heat exchanger of claim 1 is arranged within the housing to receive pressurized air from the blower.

10. The HVAC system of claim 9, wherein the panel is a v-shaped panel, wherein the v-shaped panel is shaped at a first angle.

11. The HVAC system of claim 10, wherein the first end of the coil assembly of the heat exchanger comprises a v-shaped end, wherein the v-shaped end is shaped at a second angle that is different from the first angle when the baffle is uncoupled from the coil assembly.

12. The HVAC system of claim 11, wherein the baffle comprises a deformable material, the deformable material configured to create a force when the v-shaped panel deforms to allow the first angle on the v-shaped panel to more closely align with the second angle on the v-shaped end to help secure the baffle to the coil assembly.

13. The HVAC system of claim 9, further comprising an auxiliary heat exchanger arranged within the housing.

14. A method for assembling a heat exchanger baffle with a coil assembly comprising a pair of heat exchanger coil slabs each including a first tube sheet and a second tube sheet, the method comprising:

orienting the baffle comprising a plurality of apertures located on the baffle relative to a first end of the first tube sheet and the first end of the second tube sheet, the first ends of the first and second tube sheets being located proximate a first end of the coil assembly, the first end of each tube sheet having a hook, wherein the baffle further includes two side flanges extending from a panel on opposite sides, and the apertures are located on at least one of the side flanges, and wherein orienting the baffle further includes orienting the side flanges so the apertures located on the at least one side flange is arranged proximate to the corresponding hook; and detachably engaging each aperture of the plurality of apertures with the hook located on an outer corner of the first end of each tube sheet so as to couple the baffle to the first end of the first tube sheet and the first end of the second tube sheet and thereby cap the coil assembly to minimize airflow through the first end of the coil assembly.

15. The method of claim 14, wherein the panel is a v-shaped panel defining a first angle and the first end of the coil assembly comprises a v-shaped end defining a second angle that is different from the first angle when the baffle is uncoupled from the coil assembly, and wherein orienting the baffle comprises orienting the baffle so the v-shaped panel is positioned within the v-shaped end of the coil assembly.

16. The method of claim 15, wherein detachably engaging each of the plurality of apertures comprises deforming the v-shaped panel to allow the first angle on the v-shaped panel to align more closely with the second angle on the v-shaped end when each aperture of the plurality of apertures is detachably engaged with the corresponding hook.

17. The method of claim 15, wherein there are four hooks, wherein a first pair of two of the four hooks are located on the first end of the first and a second part of two of the four hooks are located on the first end of the second tube sheets, and the plurality of apertures comprises four apertures, wherein each of the side flanges including two of the four apertures, and wherein orienting the baffle comprises orienting the side flanges so that each of the four apertures is arranged proximate to the corresponding hook.

18. The method of claim 15, wherein the hook comprises an inner engagement edge and an outer curved edge, and wherein detachably engaging each aperture comprises engaging the outer curved edge to an outer flange extending outward from each of the side flanges of the baffle to guide the at least one aperture to detachably engage with the inner engagement edge.

* * * * *